US005407266A

United States Patent [19]

Dötsch et al.

[11] Patent Number: 5,407,266

[45] Date of Patent: Apr. 18, 1995

[54] MIXING KNEADER WITH ROTATING SHAFTS AND KNEADING BARS

[75] Inventors: Winfried Dötsch, Mülheim/Körlich, Germany; Walther Schwenk, Kaiseraugst; Alfred Kunz, Witterswil, both of Switzerland

[73] Assignee: List AG, Arisdorf, Switzerland

[21] Appl. No.: 251,976

[22] Filed: Jun. 1, 1994

Related U.S. Application Data

[63] Continuation of Ser. No. 893,273, Jun. 4, 1992, abandoned.

[30] Foreign Application Priority Data

Jun. 7, 1991 [DE] Germany ..... 41 18 884.5

[51] Int. Cl.[6] ..... B01F 7/04; B01F 15/06

[52] U.S. Cl. ..... 366/97; 366/147; 366/298; 366/301

[58] Field of Search ..... 366/49, 81-85, 366/96, 97, 144, 147, 149, 297-301, 309, 312, 313; 99/348; 425/204, 208, 209

[56] References Cited

U.S. PATENT DOCUMENTS

| | | | |
|---|---|---|---|
| 3,687,422 | 8/1972 | List | 366/309 X |
| 3,689,035 | 9/1972 | List | 366/85 X |
| 3,880,407 | 4/1975 | List | 366/309 X |
| 3,964,874 | 6/1976 | Maruko et al. | 366/312 X |
| 4,014,525 | 3/1977 | Oda et al. | 366/312 X |
| 4,067,553 | 1/1978 | Yamaoka | 366/147 X |
| 4,650,338 | 3/1987 | List et al. | 366/97 X |
| 4,824,257 | 4/1989 | List et al. | 366/149 X |
| 4,826,324 | 5/1989 | Kunz et al. | 366/309 X |
| 4,857,632 | 8/1989 | Ahlberg et al. | 366/97 X |
| 4,889,431 | 12/1989 | Liechti | 366/309 X |
| 4,941,130 | 7/1990 | List et al. | 366/149 X |
| 4,950,081 | 8/1990 | List | 366/85 |

FOREIGN PATENT DOCUMENTS

| | | | |
|---|---|---|---|
| 144092 | 10/1988 | European Pat. Off. . | |
| 426127 | 5/1991 | European Pat. Off. | 366/69 |
| 2012294 | 10/1970 | Germany . | |
| 55-152534 | 11/1980 | Japan | 366/85 |
| 60-5226 | 1/1985 | Japan | 366/144 |
| 63-232828 | 9/1988 | Japan | 366/147 |
| 506322 | 6/1971 | Switzerland . | |
| 565585 | 8/1975 | Switzerland | 366/147 |
| 2200570 | 8/1988 | United Kingdom | 366/149 |
| 1505792 | 9/1989 | U.S.S.R. | 366/144 |

*Primary Examiner*—David A. Scherbel
*Assistant Examiner*—Charles Cooley
*Attorney, Agent, or Firm*—Bachman & LaPointe

[57] ABSTRACT

In a mixing kneader for carrying out mechanical, chemical and/or thermal processes, having at least two rotating shafts (5, 6) with their axes parallel, disk surfaces (21) with kneading bars (25) fitted to their periphery are to be provided at least on the one shaft designated as the main shaft (5). These kneading bars will be swept by a cleaning and/or kneading and transporting elements (7) which are fitted to the other shaft designated as a stripping shaft (6). In this arrangement, the kneading bars (25) of two neighboring disk surfaces (21) on the main shaft (5) maintain a mutual spacing (a), through which passes the cleaning and/or kneading and transporting element on the stripping shaft (6).

9 Claims, 8 Drawing Sheets

MIXING KNEADER WITH ROTATING SHAFTS AND KNEADING BARS

This is a continuation of application Ser. No. 07/893,273, filed Jun. 4, 1992, now abandoned.

BACKGROUND OF THE INVENTION

The invention relates to a mixing kneader for carrying out mechanical, chemical and/or thermal processes, having at least two rotating shafts with their axes parallel, disk surfaces with kneading bars being provided at least on the one shaft designated as the main shaft, which kneading bars are fitted to the periphery of the disk surfaces and are swept by cleaning and/or kneading and transporting elements which are fitted to the other shaft designated as a stripping shaft.

Such a multi-spindle mixing and kneading machine has been disclosed, for example, in CH-PS 506,322. One shaft thereof is provided with radial disk elements and axially aligned kneading bars arranged between the disks, and is designated as a disk shaft. Kneading elements which are shaped in the manner of frames and are fitted to the second parallel stirrer shaft engage between these disks. These kneading elements clean the disks and kneading bars of the disk shaft.

In order to achieve a reasonably adequate cleaning of the disk surfaces, the stirrer shaft must rotate faster than the disk shaft by a predetermined ratio of the speed of rotation. This ratio of the speed of rotation depends above all on the number of the kneading bars on the disk elements, since the kneading elements must engage in the interspaces between the kneading bars. This results in an inadequate cleaning effect on the disk surfaces, which in turn adversely affects the heat transfer to the product which is to be treated.

Similar comments also apply to a device according to DE-A-2,012,294, EP-A 0,144,092 and CH-A 565,585.

The present invention is based on the object of substantially improving the cleaning of all regions and parts within the mixing kneader and at the same time improving the kneading effect exerted on the product. In a thermal treatment of the product, a further object is to increase the heat exchange area within the mixing kneader and substantially to improve the heat transfer to the product.

SUMMARY OF THE INVENTION

The object is achieved when the kneading bars of two neighboring disk elements on the main shaft maintain a mutual spacing, through which passes the cleaning and/or kneading and transporting element on the stripping shaft.

In contrast to the state of the art, it is therefore no longer necessary to take a continuous kneading bar into consideration, so that regions of the disk surfaces or of the main shaft can also be cleaned, which have hitherto been inaccessible to the cleaning element. A further great advantage of the present invention is that the stripping shaft is also cleaned by the kneading bars on the disk elements. For this reason, it is possible also to heat the disk surfaces of the stripping shaft in a thermal process, since in this case the heat exchange surface of the stripping shaft is also cleaned and caking is thus avoided.

Moreover, within the scope of the invention, the cleaning and/or kneading and transporting element on the stripping shaft should preferably also consist of disk surfaces and kneading bars, the two corresponding elements being of identical design in a preferred embodiment.

If wings, which extend radially at a small distance between the main shaft and/or stripping shaft and the kneading bar, are then molded to both sides of the kneading bars, the disk surfaces on the main shaft and on the stripping shaft are almost completely cleaned. This also makes it possible to design these disk surfaces for being heated, so that the heat transfer areas are again increased. It is self-evident here that, both between the wings and between the kneading bars and also the inner wall of the mixing kneader, a multiplicity of kneading gaps is formed, by means of which the kneading of the product in the mixing kneader according to the invention is substantially improved.

A design of the disk surfaces on both the main shaft and, if desired, also on the stripping shaft depends on the requests of the user. If, for example, only a very slow product transport from a charging branch to an outlet branch is desired, the disk surfaces can be designed as closed rings which form only a narrow gap between the inner wall of the housing and the periphery of the disk surfaces, where the product can flow through. If, however, a faster transport of the product is desired, the disk surfaces can, for example, be formed in the manner of sawteeth, wings, propellers or have recesses or wavy indentations. Many variations are conceivable in this connection and the present inventive concept is intended to comprise these.

It should be mentioned that the carrier for the kneading bars of the stripping shaft does not absolutely have to be designed as a disk surface. Depending on the customer's request, the connection of kneading bar and stripping shaft could also be effected by a simple stem which can slide through the abovementioned spacing of the kneading bars of two neighboring disk elements on the main shaft. In many cases, however, disk surfaces are to be preferred since they contribute to an increase in the heat transfer and to an improvement in the kneading effect.

The spacing between the kneading bars of neighboring disk elements of the main shaft in turn has the effect that the disk surfaces of the stripping shaft or an abovementioned stem are staggered to the disk surfaces of the main shaft. Preferably, the disk surfaces or the stem are arranged in the middle between two disk surfaces of the main shaft in each case. It is self-evident that, in a preferably identical design of the kneading bars of main shaft and stripping shaft, not only two neighboring kneading bars of the main shaft maintain a spacing, but this spacing is also formed by two neighboring kneading bars of the stripping shaft, albeit with an offset, the disk surface of the main shaft then sweeping through the latter spacing.

While the kneading bars are preferably of identical design, this can admittedly also apply to the disk surfaces of main shaft and stripping shaft, but they can also be of different design, depending on the request of the user, so that a product transport through the stripping shaft proceeds in a way different from that through the main shaft. The invention here allows for many possibilities.

In an illustrative example of the invention, the main shaft and stripping shaft rotate in the same clockwise direction. Equally, however, the disk and/or cleaning elements according to the invention also allow rotation of the main shaft and stripping shaft in opposite direction. It is also possible to rotate the main shaft and stripping shaft at the same or else at a different speed of rotation. In the case of rotation, either in the same direction or in opposite directions, at the same speed of rotation, the number of the kneading bars on the main shaft should correspond to that on the stripping shaft. In this way, the most advantageous cleaning for this speed of rotation can be achieved, without the kneading bars interfering with one another.

If, however, the main shaft and stripping shaft rotate at different speeds of rotation, the number of the kneading bars arranged on the main shaft and on the stripping shaft should be inversely proportional to the ratio of the speeds of rotation. If, for example, the ratio of the speeds of rotation of main shaft and stripping shaft is 1:4, four kneading bars are fitted to the main shaft and only one kneading bar to the stripping shaft. It is also possible to provide eight kneading bars on the main shaft and two kneading bars on the stripping shaft.

If the ratio of the speeds of rotation is odd, for example 1:1.25, five kneading bars are fitted to the main shaft, and four kneading bars to the stripping shaft.

Summarizing, it must be stressed that the present mixing kneader allows wide flexibility with respect to the arrangement of the shaft elements, the number of the kneading bars and the ratio of the speeds of rotation. The main advantages are improved self-cleaning, a larger specific heat exchange area, a more effective surface renewal in the case of diffusion-controlled evaporation processes, a more intensive mixing effect with gentle kneading and lower compaction as well as a narrow residence time spectrum.

BRIEF DESCRIPTION OF THE DRAWINGS

Further advantages, features and details of the invention can be seen from the following description of preferred illustrative examples and by reference to the drawings, in which.

DETAILED DESCRIPTION OF PREFERRED EMBODIMENTS

Figure 1:
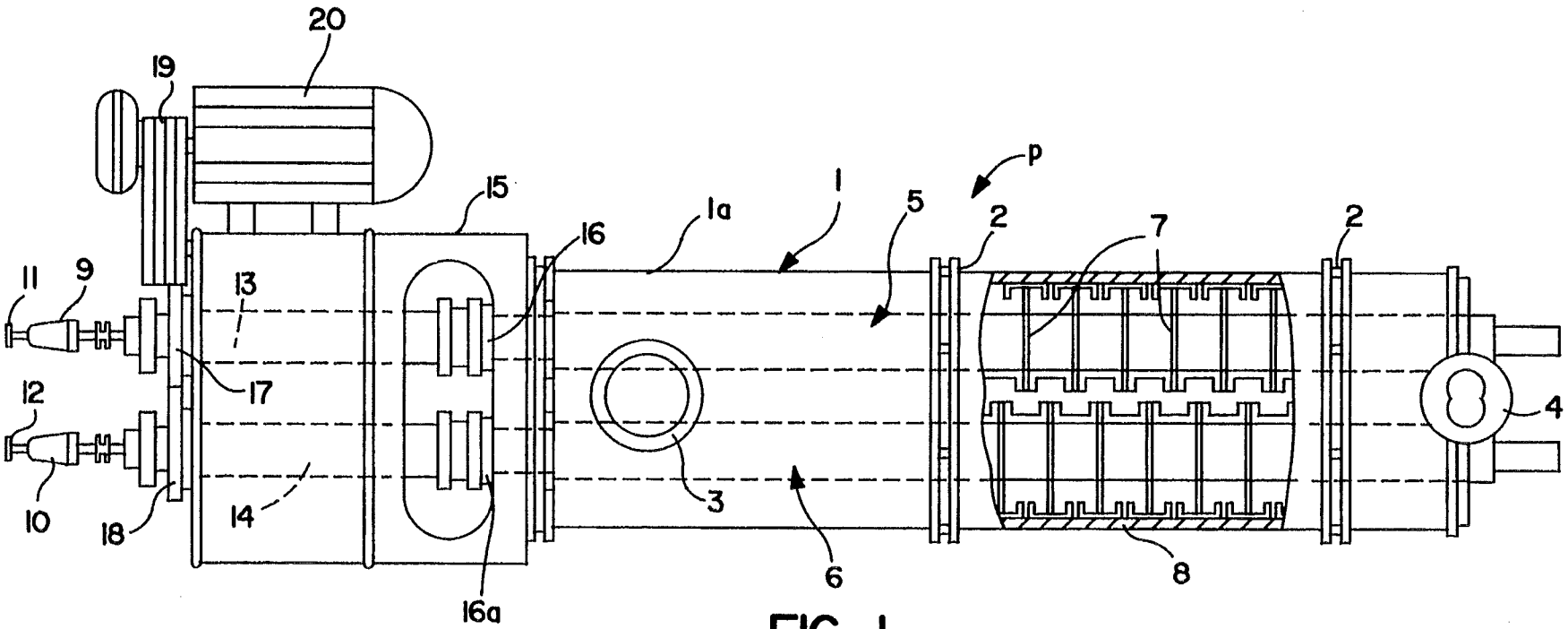
FIG. 1 shows a plan view of a mixing kneader according to the invention, with the housing partially cut open.

A mixing kneader P has, according to FIG. 1, a housing 1 which consists of a plurality of housing sections 1*a*, 1*b* and 1*c*. The housing sections are coupled to one another by appropriate flanged joints 2. A charging branch 3 for a product to be treated in the mixing kneader is provided in the housing section 1*a*, and an outlet branch 4 for the treated product is provided in the housing section 1*c*.

The product is transported from the charging branch 3 to the outlet branch 4 by means of two shafts 5 and 6 and by kneading and transporting elements 7 fitted thereto. During the transport, mixing and kneading of the product and, preferably, thermal treatment take place. For this purpose, the shafts 5 and 6 and, if appropriate, also the kneading and transporting elements 7 and the housing wall 8, which is not shown in more detail, are heated. To introduce a heating medium into the shafts 5 and 6 and from there, if appropriate, into the interior of the kneading and transporting elements 7, connections 9 and 10 are provided, these connections 9 and 10 being arranged around corresponding outlet nipples 11 and 12 for the heating medium which is passed through the shafts 5 and 6. A corresponding path of the heating medium in jacket surfaces of the shafts 5 and 6 and a corresponding return path through the outlet nipples 11 and 12 are state of the art and are therefore not further described here.

Between the connections 9 and 10, shaft journals 13 and 14 connected to the shafts 5 and 6 pass through a bonnet 15, stuffing boxes 16 and 16*a* for sealing each of the shafts 5 and 6 respectively against the housing 1 being provided. The shaft journals 13 and 14 are coupled to one another outside the bonnet by corresponding gear elements 17 and 18, for example gear wheels, the gear element 17 being connected via a gearbox 19 to a drive 20. Via this drive 20 and the gearbox 19, at least the gear element 17 is sent into rotary motion which is transmitted to the shaft 5. A transmission of this rotary motion to the gear element 18 can be in the same direction or opposite direction and at the same or a different speed of rotation. The corresponding step-up gears are commercially available and are not to be described here in more detail.

The essential point within the scope of the present invention is the design of the kneading and transporting elements 7 and their arrangement on the shafts 5 and 6. For the sake of clarity, the shaft 5 is also designated below as the main shaft, and the shaft 6 is also designated as the stripping shaft. Kneading and transporting elements 7 are fitted to each shaft 5 and 6, and these have, as the base, disk surfaces 21 towards the particular shaft 5 or 6 respectively. In FIGS. 5 to 8, various illustrative examples of disk surfaces 21 are shown. According to FIG. 5, disk surfaces 21 a are formed as a continuous ring arranged around the particular shaft 5 or 6.

Figure 6:
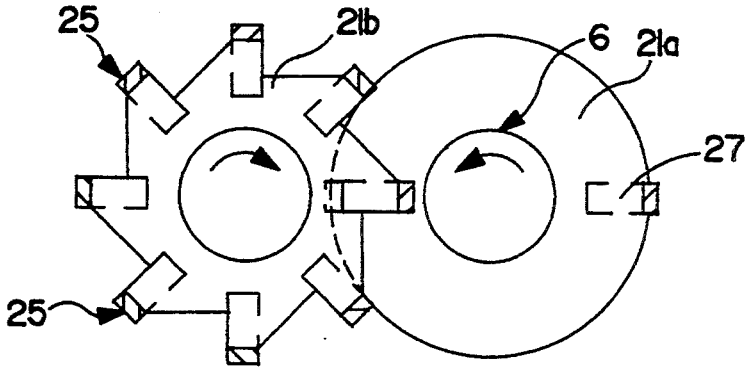
FIG. 6 shows a section through a further illustrative example of two shafts corresponding to FIG. 5, FIGS. 7 and 8 show sections through further illustrative examples of shafts corresponding to FIG. 5.
Figure 7:
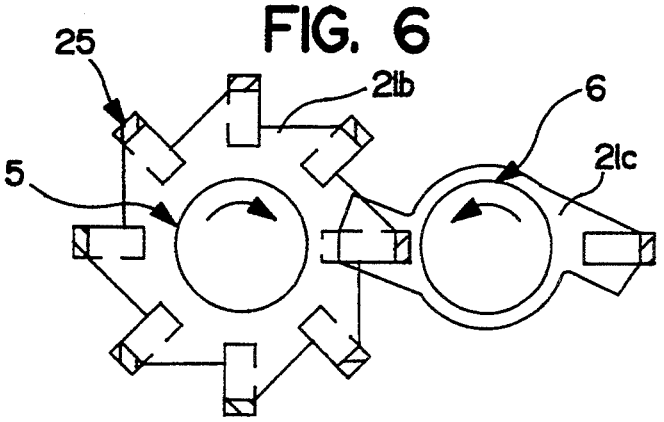
Figure 8:
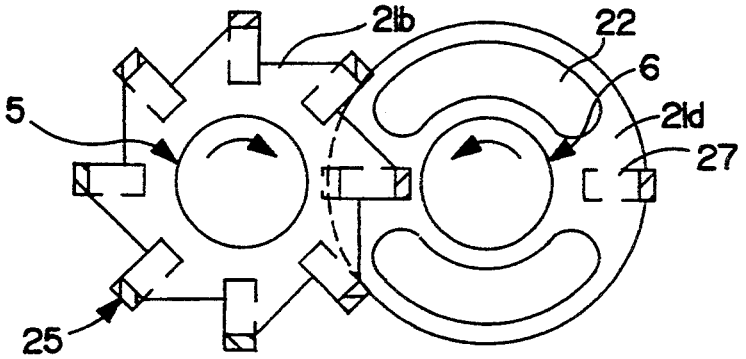

A disk surface 21*b* according to FIG. 6, formed in the manner of sawteeth, allows better product transport. In FIG. 7 it is shown that the disk surfaces 21*c* of the stripping shaft 6 are now formed only as wings, whereas disk surfaces 21*d* according to FIG. 8 have recesses 22, through which the product to be worked can be transported.

Figure 15:
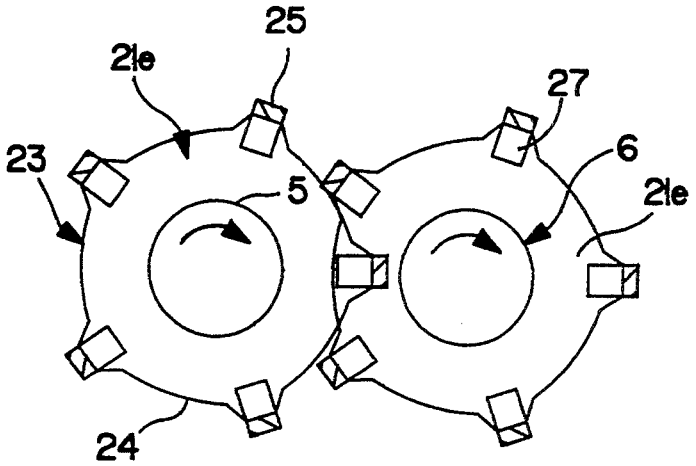
FIGS. 15 and 16 show sections through further illustrative examples of shafts corresponding to FIG. 14.
Figure 16:
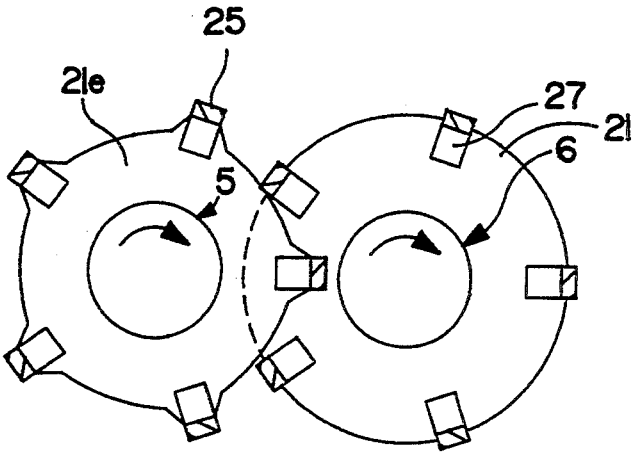
Figure 17:
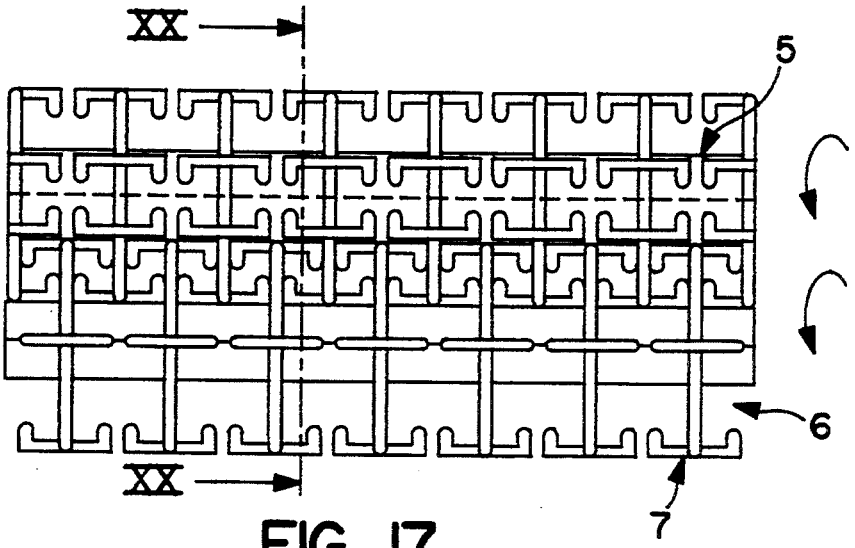
FIG. 17 shows a plan view of a detail of a further illustrative example of a mixing kneader in the region of two interacting shafts.
Figure 18:
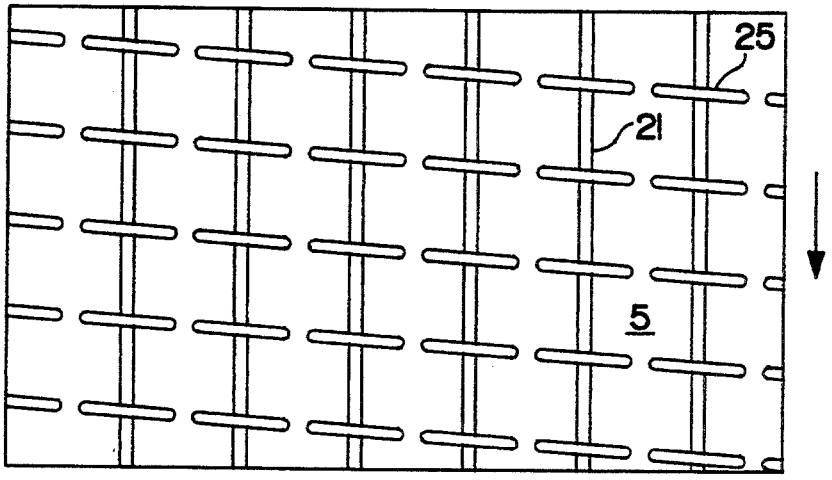
FIG. 18 shows a plan view of a detail of a development of one shaft according to FIG. 17.
Figure 19:
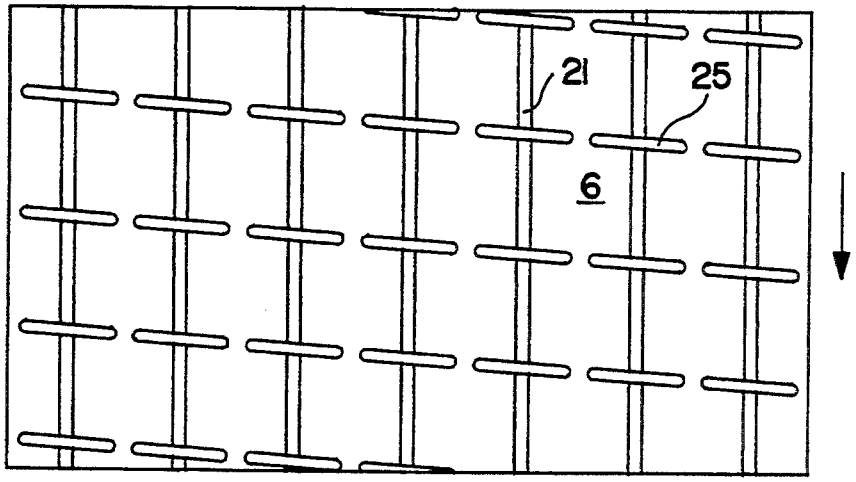
FIG. 19 shows a plan view of a detail of the development of the other shaft according to FIG. 17.
Figure 20:
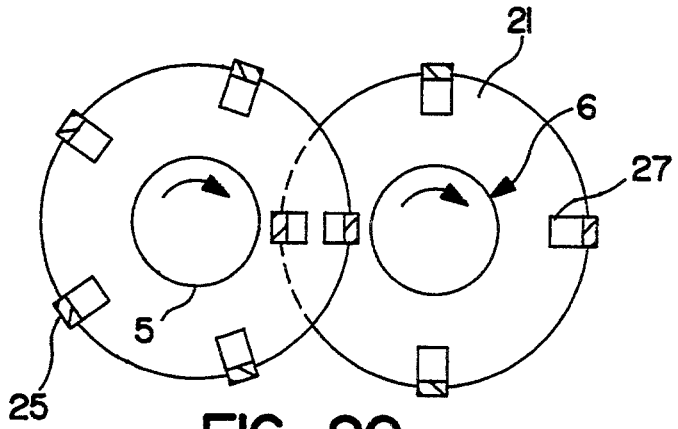
FIG. 20 shows a section through the two shafts along the line XX—XX in FIG. 17, and FIGS. 21 to 23 show sections through further illustrative examples of shafts from a mixing kneader corresponding to FIG. 20.
Figure 21:
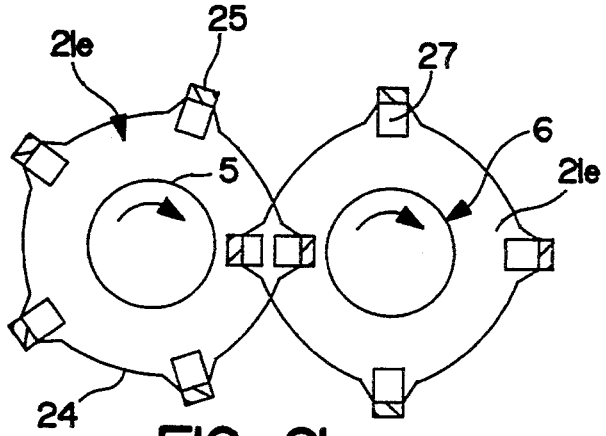
Figure 22:
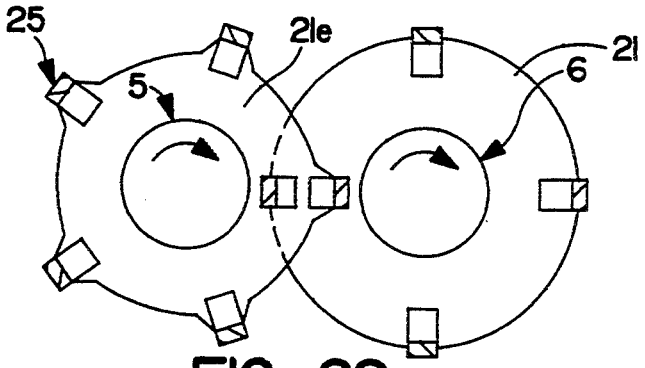
Figure 23:
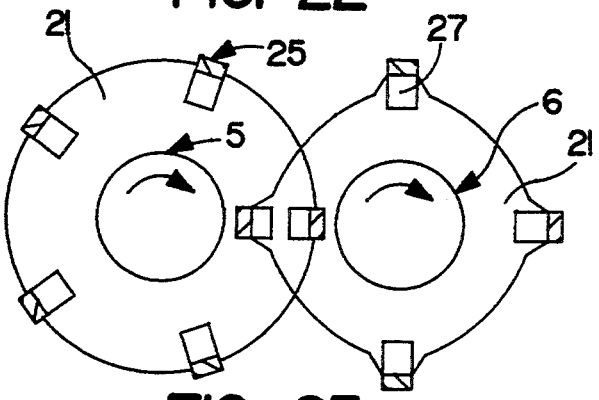

A further variant of a disk surface 21*e* is to be found in FIGS. 15 and 16 and also 21 to 23. In these, a disk surface periphery 23 no longer has a circular shape, but has wavy indentations 24. Moreover, propeller-like disk wings are also conceivable, as is shown in DE-OS 2,012,294 and in CH-PS 506,322. The inventive concept in the present illustrative example is not intended to be restricted to the shapes shown. Within the scope of the invention, there is still a multiplicity of further designs of the disk surfaces 21. Since the kneading and transporting elements 7 of both of the main shaft 5 and of the stripping shaft 6 are preferably of identical design, except for the design of the disk surfaces 21, they will be provided with the same reference numerals below. Of course, within the scope of the present invention, this leaves undecided whether the kneading and transporting elements 7 of the main shaft 5 are designed in a way different from those on the stripping shaft 6.

Figure 2:
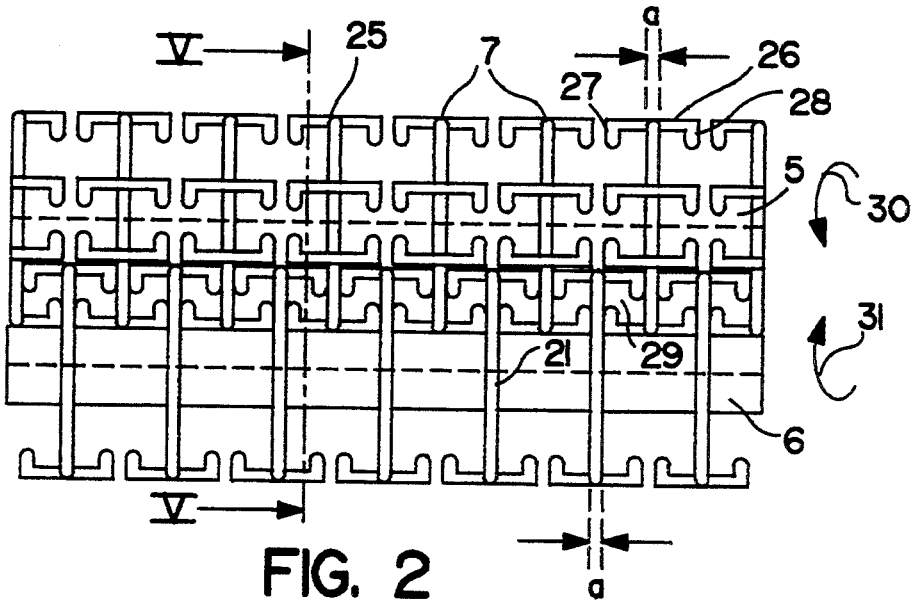
FIG. 2 shows a plan view of a detail of two interacting shafts.

The essential point is that there are kneading bars 25 of U-shaped design on the disk surface periphery 23 of both the main shaft 5 and, if a disk surface 21 is provided, of the stripping shaft 6. That is to say, an actual carrier arm 26 is seated on the disk surface periphery 23, while wings 27 and 28 protrude from this carrier arm 26 on both sides towards the particular shaft 5 or 6. This then results in a kneading and transporting element 7, as shown especially in FIG. 2, which shows a T-shaped design in plan view.

A further essential point is that two neighboring kneading and transporting elements 7 or neighboring wings 27 thereof maintain a mutual spacing a which allows a disk surface 21 of the opposite shaft 5 or 6 to pass through the spacing. Accordingly, this spacing a is slightly greater than the thickness *d* of a disk surface 21.

The disk surfaces 21 of the main shaft 5 and stripping shaft 6 are also arranged with a mutual offset. Preferably, this offset is such that a disk surface 21 of the stripping shaft 6 engages approximately in the middle between two disk surfaces 21 of the main shaft 5. However, this offset can also form off-center, kneading spaces 29 of correspondingly different width. However, the design with identical kneading spaces 29 is preferred.

Figure 3:
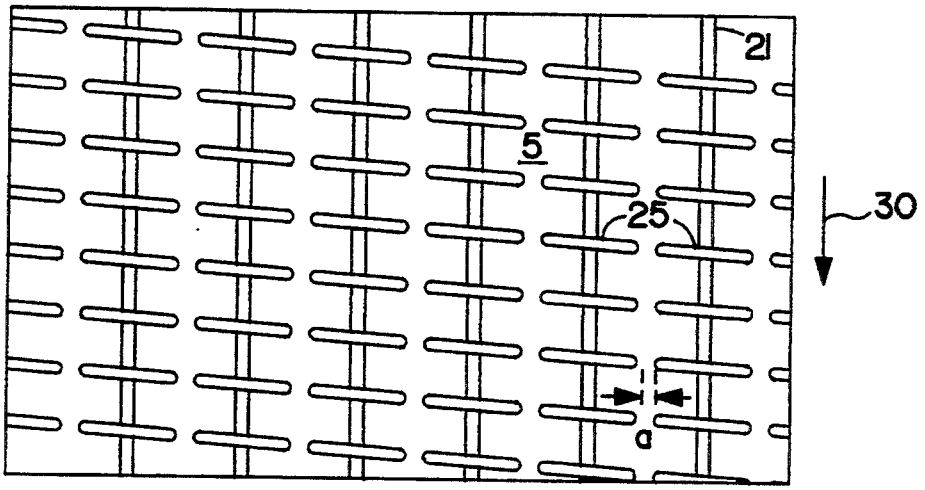
FIG. 3 shows a plan view of a detail of a development of one shaft according to FIG. 2.
Figure 4:
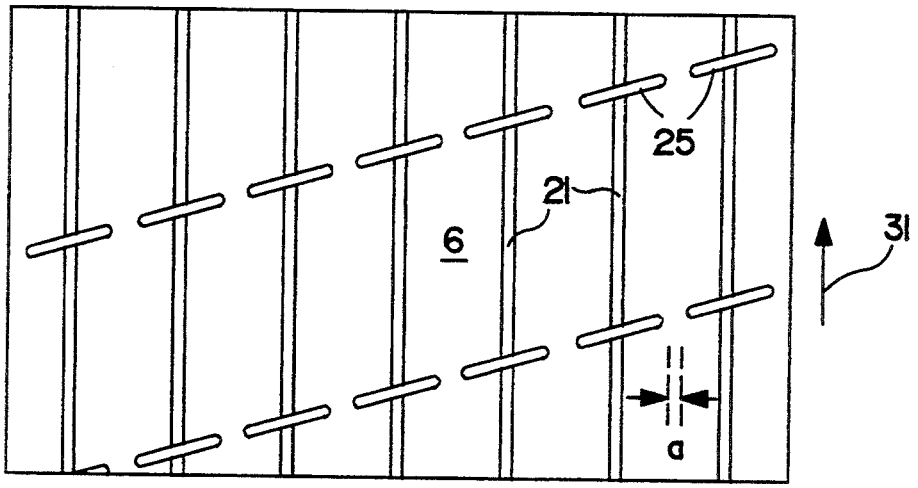
FIG. 4 shows a plan view of a detail of a development of the other shaft according to FIG. 2.
Figure 5:
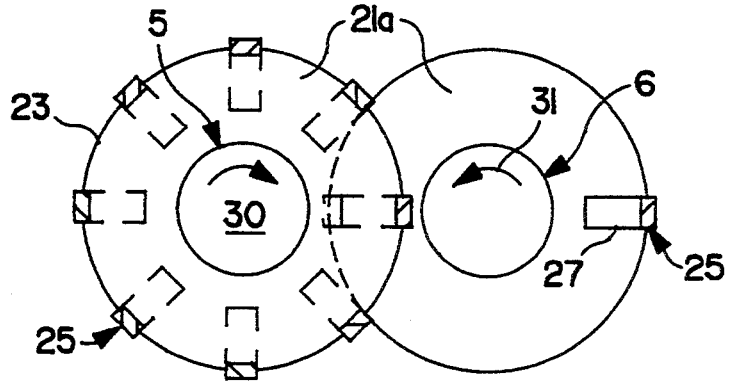
FIG. 5 shows a section through the two shafts according to FIG. 2 along the line V—V.

In FIGS. 3 and 4, it can be seen that the kneading bars 25 are arranged at an oblique angle relative to the axial direction of the shafts 5 and 6. This improves the transport action. Furthermore, the arrows 30 and 31 indicate that the main shaft and stripping shaft rotate in opposite directions.

FIGS. 5 to 8 show the interplay of the kneading and transporting elements of the main shaft 5 and stripping shaft 6. A motion of the main shaft 5 and stripping shaft 6 in opposite directions in the ratio of 1:4 takes place here, i.e. the stripping shaft 6 rotates four times as fast as the main shaft 5. The result is that eight kneading bars 25 are provided on the main shaft or on the disk surfaces 21*a* arranged there, whereas two kneading bars, located diametrically opposite, on the disk surfaces 21*a* of the stripping shaft 6 are sufficient. It would also be possible here to arrange only one kneading bar on the disk surfaces of the stripping shaft, while four kneading bars are provided on the disk surfaces of the main shaft. In other words, the number of kneading bars on the disk surfaces of the stripping shaft relative to the kneading bars of the disk surfaces of the main shaft is in the normal case in an inverse ratio to the speeds of rotation of the two shafts. Since, however, the tracks of the kneading bars of the main shaft on the stripping shaft can be identical, the number of kneading bars on the main shaft can also be reduced, if desired.

Figure 10:
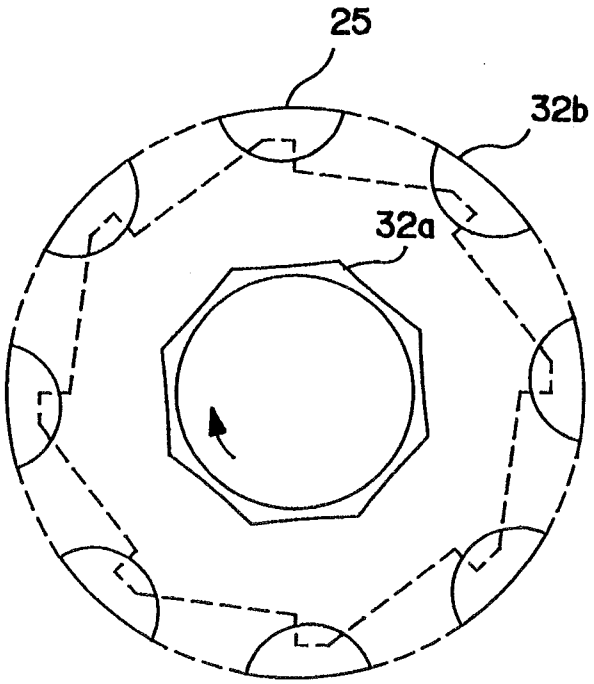
FIG. 10 shows a section through a main shaft with uncleaned surfaces according to the present invention indicated by hatching.
Figure 9:
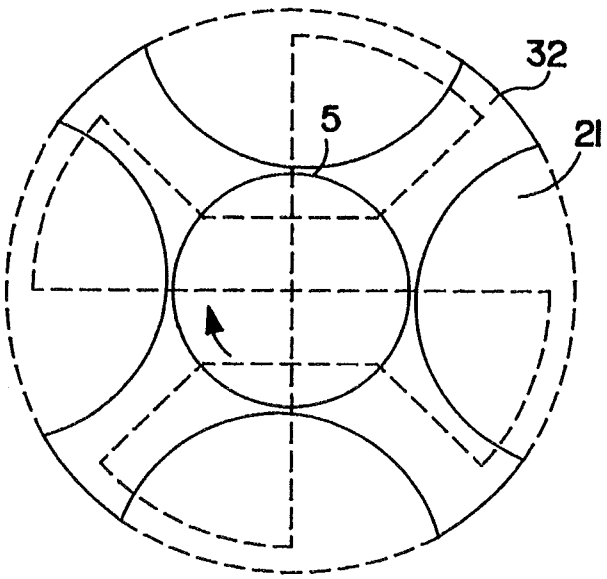
FIG. 9 PRIOR ART
FIG. 9 shows a section through a main shaft with uncleaned surfaces on disk elements according to CH-PS 506,322 indicated by hatching.
Figure 11:
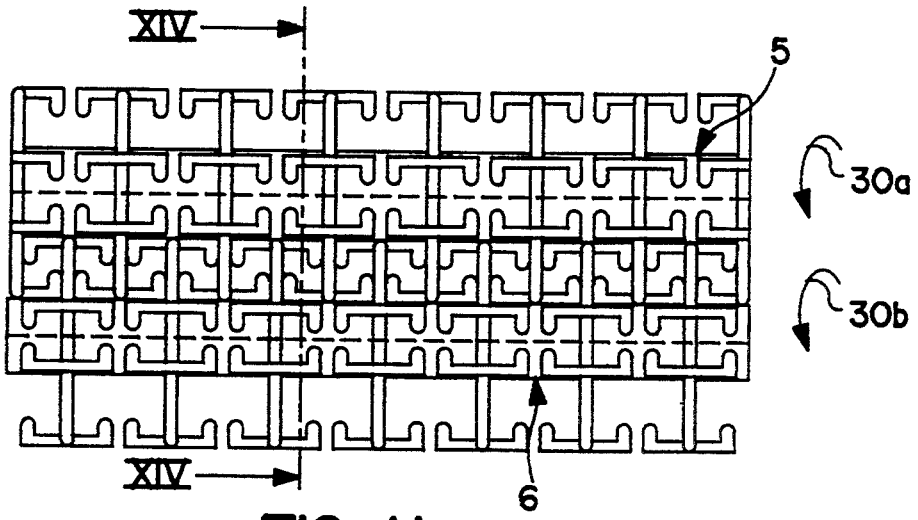
FIG. 11 shows a plan view of a detail of a further illustrative example of a mixing kneader according to the invention in the region of two interacting shafts.
Figure 12:
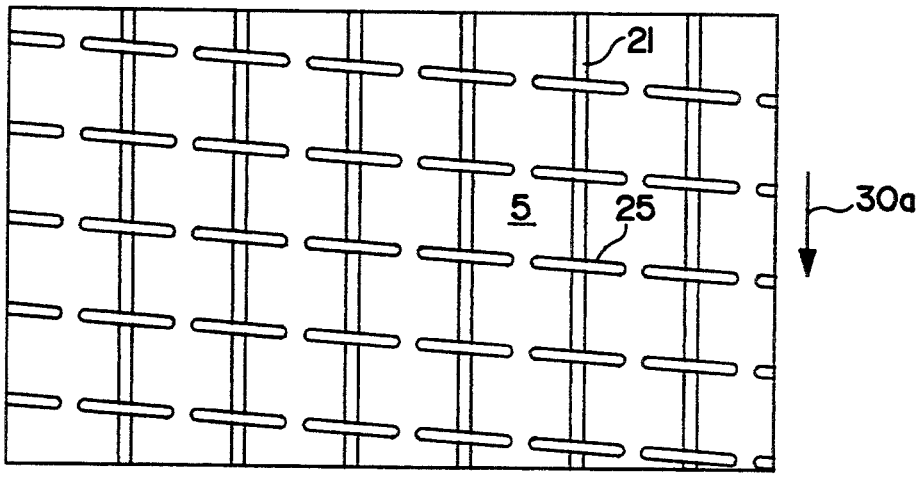
FIG. 12 shows a plan view of a detail of a development of one shaft from FIG. 11.
Figure 13:
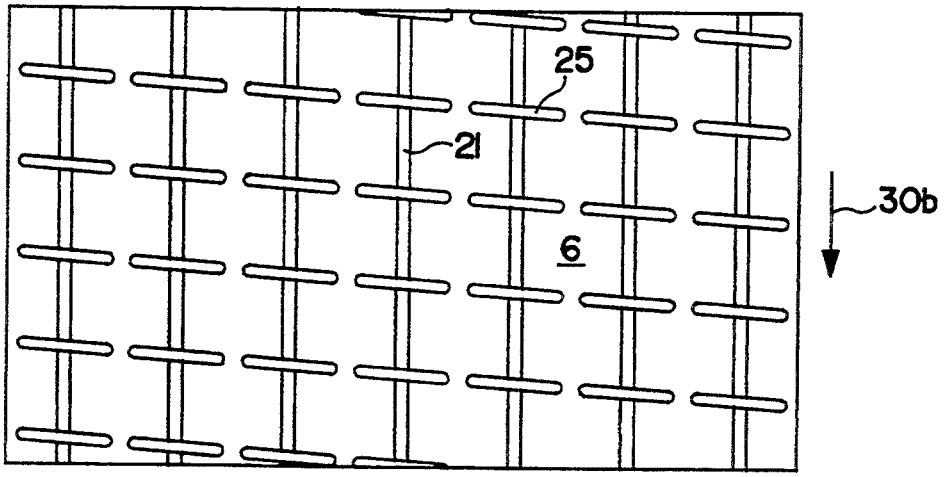
FIG. 13 shows a plan view of a detail of a development of the other shaft according to FIG. 11.
Figure 14:
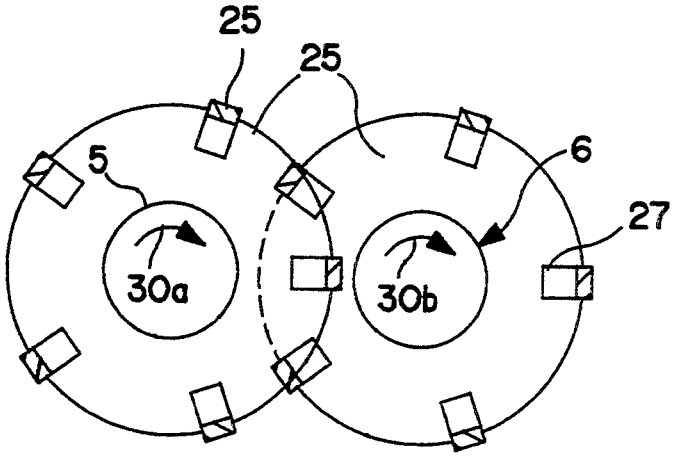
FIG. 14 shows a diagrammatically represented section through the two shafts according to FIG. 11 along the line XIV—XIV.

The advantageous cleaning effect of the present invention if compared with, for example, CH-PS 506,322 can be clearly seen in a comparison of FIGS. 9 and 10. In FIG. 9, uncleaned surfaces 32 shown hatched are still present to a relatively large extent on a disk surface 21. In FIG. 10, it can be seen by contrast that there are no longer any cohering uncleaned surfaces and that, instead, only certain regions 32 a close to the main shaft 5 and certain regions 32*b* around the kneading bars 25 have not been cleaned. The uncleaned areas are thus so small that the heat exchange between the disk surface 21 and the product to be treated has been improved to a quite outstanding extent.

The illustrative examples in FIGS. 11 to 16 differ from those just described in that the main shaft 5 rotates in the same direction as the stripping shaft 6. This is indicated by the two arrows 30*a* and 30*b*. Moreover, both shafts 5 and 6 run at the same speed of rotation, so that the number Of the kneading bars 25 arranged on the disk surfaces 21 is also equal. The disk surfaces 21 on the two shafts 5 and 6 are soley arranged with a mutual offset or are staggered.

The wavy indentations 24 in the disk surface 21*e* according to FIGS. 15 and 16 permit more rapid product transport or more rapid passage of resulting gases or vapors.

Of course, a non-integral division is also possible, for example if the ratio of the speed of rotation of the main shaft 5 and stripping shaft 6 is 1:1.25. In this case, five kneading bars 25 are then arranged on the main shaft, as shown in FIGS. 17 to 23, whereas there are only four kneading bars in symmetrical distribution on the disk surfaces 21 of the stripping shaft 6. The present invention thus permits an extra-ordinary diversity of ratios of the speed of rotation and of the number of kneading bars on each disk surface.

We claim:

1. Mixing kneader for carrying out at least one of mechanical, chemical and thermal processes, which comprises:

at least two rotating shafts having their axes parallel to each other, with one of said shafts being a main shaft and a second of said shafts being a stripping shaft, including means to rotate said shafts such that said main shaft and said stripping shaft rotate in the same direction and at different speeds of rotation;

disk surfaces having disk surface peripheries provided on both shafts;

kneading bars extending from each disk surface of the main shaft and fitted to the peripheries of the disk surfaces of the main shaft, said kneading bars of the main shaft having distal ends with wings attached to the distal ends, said wings spaced a small distance from a respective disk surface of the main shaft, so that the kneading bars of the main shaft are of U-shaped design;

with neighboring kneading bars of two neighboring disk surfaces on the main shaft maintaining a mutual spacing therebetween; and wherein each of said disk surfaces on the stripping shaft has a U-shaped kneading bar fitted to the peripheries of the disk surfaces on the stripping shaft which kneading bars are positioned from a neighboring kneading bar of another of said disk surfaces on the stripping shaft to form a space there between, the kneading bars of the stripping shaft intermeshing with kneading bars of the main shaft, the disk surfaces of the stripping shaft sweep through said mutual spacing, and wherein the disk surfaces of the main shaft sweep through said space between the neighboring kneading bars of the stripping shaft; and wherein the disk surface peripheries of the main shaft have a form selected from the group consisting of rings having sawteeth-like projections and rings having wavy indentations, and wherein the disk surface peripheries of the stripping shaft have a form selected from the group consisting of rings having sawteeth-like projections and rings having wavy indentations.

2. Mixing kneader according to claim 1 wherein the disk surfaces of the stripping shaft are staggered relative to the disk surfaces of the main shaft.

3. Mixing kneader according to claim 2 wherein each of the disk surfaces of the stripping shaft are arranged in the middle between two neighboring disk surfaces of the main shaft.

4. Mixing kneader according to claim 1 wherein the disk surfaces of the main shaft and stripping shaft are one of identical design and different design.

5. Mixing kneader according to claim 1 wherein the means to rotate said shafts is operative to rotate the main shaft and the stripping shaft in a counter-clockwise direction.

6. Mixing kneader according to claim 1 wherein the number of kneading bars on the main shaft corresponds to the number of kneading bars on the stripping shaft.

7. Mixing kneader according to claim 1 wherein the number of kneading bars on the main shaft and the stripping shaft is inversely proportional to the ratio of the speeds of rotation of their respective shafts.

8. Mixing kneader according to claim 1 including means for heating the disk surfaces of the main shaft and of the stripping shaft.

9. Mixing kneader according to claim 1 including means for heating the main shaft and the stripping shaft.

* * * * *